US006424316B1

(12) United States Patent
Leisten

(10) Patent No.: US 6,424,316 B1
(45) **Date of Patent: *Jul. 23, 2002**

(54) HELICAL ANTENNA

(75) Inventor: Oliver Paul Leisten, Duston (GB)

(73) Assignee: Sarantel Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/684,280

(22) Filed: Oct. 6, 2000

Related U.S. Application Data

(63) Continuation of application No. 09/204,863, filed on Dec. 3, 1998, now Pat. No. 6,181,297, which is a continuation of application No. 08/351,631, filed on Dec. 6, 1994, now Pat. No. 5,854,608.

(30) Foreign Application Priority Data

Aug. 25, 1994 (GB) ..... 9417450

(51) Int. Cl.[7] ..... H01Q 1/36
(52) U.S. Cl. ..... 343/895; 343/821
(58) Field of Search ..... 343/895, 821, 343/822, 702

(56) References Cited

U.S. PATENT DOCUMENTS 5,612,707 A * 3/1997 Vaughan et al. ..... 343/895
5,854,608 A * 12/1998 Leisten ..... 343/895
5,859,621 A * 1/1999 Leisten ..... 343/895
5,986,616 A * 11/1999 Edvardsson ..... 343/895
6,181,297 B1 * 1/2001 Leisten ..... 343/895
6,184,845 B1 * 2/2001 Leisten et al. ..... 343/895
6,232,929 B1 * 5/2001 Ermutlu et al. ..... 343/895

* cited by examiner

*Primary Examiner*—Tan Ho
(74) *Attorney, Agent, or Firm*—Gary Cary Ware & Freidenrich LLP

(57) ABSTRACT

An antenna for use at UHF and upwards has a cylindrical ceramic core with a relative dielectric constant of at least 5. A three-dimensional radiating element structure, including helical antenna elements on the cylindrical surface of the core and connecting radial elements on a distal end face of the core, is formed by conductor tracks plated directly on the core surfaces. At the distal end face, the elements are connected to an axially located feed structure in a plated axial passage of the core. The antenna elements are grounded on a plated sleeve covering a proximal part of the core which, in conjunction with the feeder structure, forms an integral balun for matching to an unbalanced feeder. Since the ceramic core fills the major part of the interior volume defined by the radiating element structure, the antenna is very much smaller than an air-cored antenna.

46 Claims, 2 Drawing Sheets

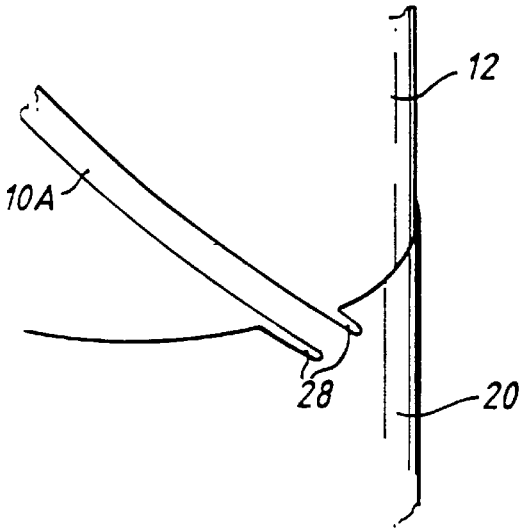
Fig.3.
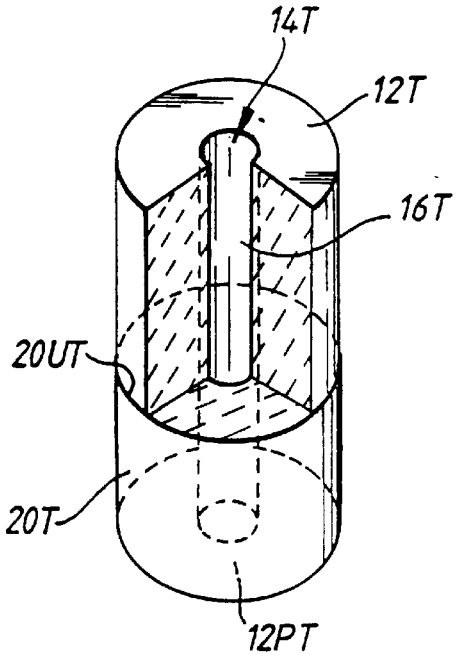
Fig.4.
Fig.5.
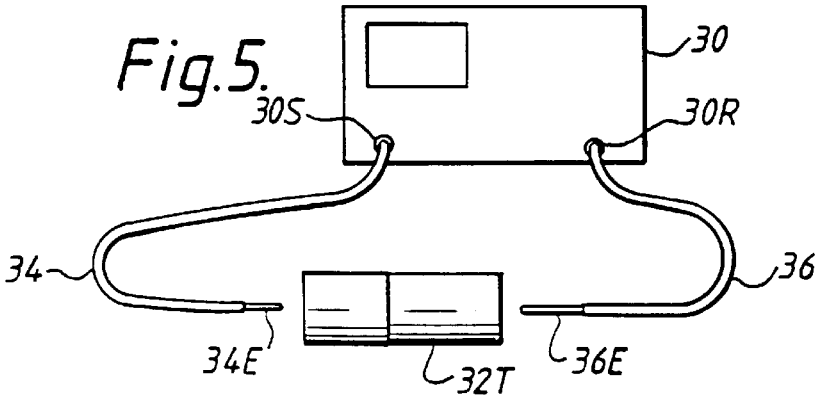
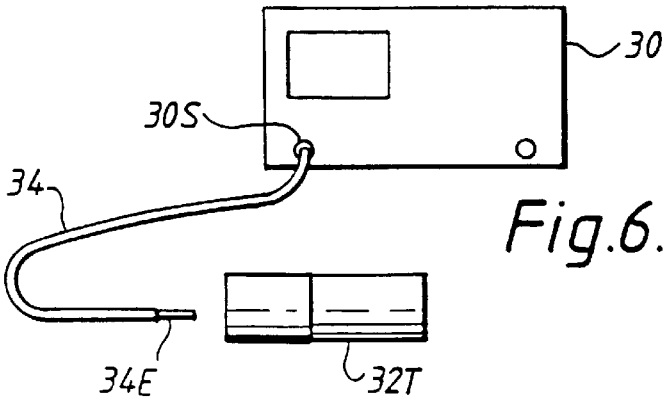
Fig.6.

HELICAL ANTENNA

RELATIONSHIP TO COPENDING APPLICATIONS

This application is a Continuation of application Ser. No. 09/204,863, filed Dec. 3, 1998, now U.S. Pat. No. 6,181,297 which is a Continuation of Application Ser. No. 08/351,631, filed Dec. 6, 1994, now U.S. Pat. No. 5,854,608, both of which are incorporated herein by reference in their entirety.

FIELD OF THE INVENTION

This invention relates to an antenna for operation at frequencies in excess of 200 MHz, and in particular to an antenna which has a three-dimensional antenna element structure.

BACKGROUND OF THE INVENTION

British Patent No. 2258776 discloses an antenna which has a three-dimensional antenna element structure by virtue of having a plurality of helical elements arranged around a common axis. Such an antenna is particularly useful for receiving signals from satellites, for example, in a GPS (global positioning system) receiver arrangement. The antenna is capable of receiving circularly polarised signals from sources which may be directly above the antenna, i.e. on its axis, or at a location a few degrees above a plane perpendicular to the antenna axis and passing through the antenna, or from sources located anywhere in the solid angle between these extremes.

While being intended mainly for reception of circularly polarised signals, such an antenna, due to its three-dimensional structure, is also suitable as an omnidirectional antenna for receiving vertically and horizontally polarised signals.

One of the disadvantages of such an antenna is that in certain applications it is insufficiently robust, and cannot easily be modified to overcome this difficulty without a performance penalty. For this reason, antennas which are to receive signals from the sky in harsh environments, such as on the outside of an aircraft fuselage, are often patch antennas, being simply plates (generally plated metallic square patches) of conductive material mounted flush on an insulated surface which may be part of the aircraft fuselage. However, patch antennas tend to have poor gain at low angles of elevation. Efforts to overcome this disadvantage have included using a plurality of differently oriented patch antennas feeding a single receiver. This technique is expensive, not only due to the numbers of elements required, but also due to the difficulty of combining the received signals.

SUMMARY OF THE INVENTION

According to one aspect of this invention an antenna for operation at a frequency in excess of 200 MHz comprises an electrically insulative antenna core of a material having a relative dielectric constant greater than 5, a three-dimensional antenna element structure disposed on or adjacent the outer surface of the core and defining an interior space, and a feeder structure which is connected to the element structure and passes through the core, the material of the core occupying the major part of the said interior space.

Typically the element structure comprises a plurality of antenna elements defining an envelope centred on a feeder structure which lies on a central longitudinal axis. The core is preferably a cylinder and the antenna elements preferably define a cylindrical envelope which is coaxial with the core. The core may be a cylindrical body which is solid with the exception of a narrow axial passage housing the feeder. Preferably, the volume of the solid material of the core is at least 50 percent of the internal volume of the envelope defined by the elements, with the elements lying on an outer cylindrical surface of the core. The elements may comprise metallic conductor tracks bonded to the core outer surface, for example by deposition or by etching of a previously applied metallic coating.

For reasons of physical and electrical stability, the material of the core may be ceramic, e.g. a microwave ceramic material such as zirconium-titanate-based material, magnesium calcium titanate, barium zirconium tantalate, and barium neodymium titanate, or a combination of these. The preferred relative dielectric constant is upwards of 10 or, indeed, 20, with a figure of 36 being attainable using zirconium-titanate-based material. Such materials have negligible dielectric loss to the extent that the Q of the antenna is governed more by the electrical resistance of the antenna elements than core loss.

A particularly preferred embodiment of the invention has a cylindrical core of solid material with an axial extent at least as great as its outer diameter, and with the diametrical extent of the solid material being at least 50 percent of the outer diameter. Thus, the core may be in the form of a tube having a comparatively narrow axial passage of a diameter at most half the overall diameter of the core. The inner passage may have a conductive lining which forms part of the feeder structure or a screen for the feeder structure, thereby closely defining the radial spacing between the feeder structure and the antenna elements. This helps to achieve good repeatability in manufacture. This preferred embodiment has a plurality of generally helical antenna elements formed as metallic tracks on the outer surface of the core which are generally co-extensive in the axial direction. Each element is connected to the feeder structure at one of its ends and to a ground or virtual ground conductor at its other end, the connections to the feeder structure being made with generally radial conductive elements, and the ground conductor being common to all of the helical elements.

According to another aspect of the invention, an antenna for operation at a frequency in excess of 200 MHz comprises a solid electrically insulative antenna core which has a central longitudinal axis and is made of a material having a relative dielectric constant greater than 5, a feeder structure extending through the core on the central axis, and, disposed on the outer surface of the core, a radiating element structure comprising a plurality of antenna elements which are connected to the feeder structure at one end of the core and extend in the direction of the opposite end of the core to a common grounding conductor. The core preferably has a constant external cross-section in the axial direction, with the antenna elements being conductors plated on the surface of the core. The antenna elements may comprise a plurality of conductor elements extending longitudinally over the portion of the core having a constant external cross-section, and a plurality of radial conductor elements connecting the longitudinally extending elements to the feeder structure at the said one end of the core. The phrase "radiating element structure" is used in the sense understood by those skilled in the art, that is to mean elements which do not necessarily radiate energy as they would when connected to a transmitter, and to mean, therefore, elements which either collect or radiate electromagnetic radiation energy. Accordingly the antenna devices which are the subject of this specification may be used in apparatus which only receives signals, as well as in apparatus which both transmits and receives signals.

In a particularly preferred embodiment of the invention, the antenna includes an integral balun formed by a conductive sleeve extending over part of the length of the core from a connection with the feeder structure at the above-mentioned opposite end of the core. The balun sleeve may thus also form the common grounding conductor for the longitudinally extending conductor elements. In the case of the feeder structure comprising a coaxial line having an inner conductor and an outer screen conductor, the conductive sleeve of the balun is connected at the said opposite end of the core to the feeder structure outer screen conductor.

The preferred embodiment of the antenna, having a core which is a solid cylinder, includes an antenna element structure comprising at least four longitudinally extending elements on the cylindrical outer surface of the core and corresponding radial elements on a distal end face of the core connecting the longitudinally extending elements to the conductors of the feeder structure. Preferably, these longitudinally extending antenna elements are of different lengths. In particular, in the case of an antenna having four longitudinally extending elements, two of the elements are of greater length than the other two by virtue of following meandered paths on the outer surface of the core. In the case of an antenna for circularly polarised signals, all four elements follow a generally helical path, the longer of the two elements each following a meandering course which deviates, preferably, sinusoidally on each side of a helical centre line. The conductor elements connecting the longitudinally extending elements to the feeder structure at the distal end of the core are preferably simple radial tracks which may be inwardly tapered.

Using the above-described features it is possible to make an antenna which is extremely robust due to its small size and due to the elements being supported on a solid core of rigid material. Such an antenna can be arranged to have the same low-horizon omni-directional response as the prior art antenna which is mainly air-cored, but with robustness sufficient for use as a replacement for patch antennas in certain applications. Its small size and robustness render it suitable also for unobtrusive vehicle mounting and for use in handheld devices. It is possible in some circumstances even to mount it directly on a printed circuit board. Since the antenna is suitable for receiving not only circularly polarised signals, but also vertically or horizontally polarised signals, it may be used not only in satellite navigation receivers but also in different types of radio communication apparatus such as handheld mobile telephones, an application to which it is particularly suited in view of the unpredictable nature of the received signals, both in terms of the direction from which they are received, and the polarisation changes brought about through reflection.

Expressed in terms of operating wavelength in air $\lambda$, the longitudinal extent of the antenna elements, i.e. in the axial direction, is typically within the range of from $0.03\lambda$ to $0.06\lambda$, and the core diameter is typically $0.02\lambda$ to $0.03\lambda$. The track width of the elements is typically $0.0015\lambda$ to $0.0025\lambda$, while the deviation of the meandered tracks from a helical mean path is $0.0035\lambda$ to $0.0065\lambda$ on each side of the mean path, measured to the centre of the meandered track. The length of the balun sleeve is typically in the range of from $0.03\lambda$ to $0.06\lambda$.

According a third aspect of the invention, there is provided an antenna for operation at a frequency in excess of 200 MHz, wherein the antenna comprises an antenna element structure in the form of at least two pairs of helical elements formed as helices having a common central axis, a substantially axially located feeder structure having an inner feed conductor and an outer screen conductor with each helical element having one end coupled to a distal end of the feeder structure and its other end connected to a common grounding conductor, and a balun comprising a conductive sleeve located coaxially around the feeder structure, the sleeve being spaced from the outer screen of the feeder structure by a coaxial layer of insulative material having a relative dielectric constant greater than 5, with the proximal end of the sleeve connected to the feeder structure outer screen. Preferably, the axial length of the helical elements is greater than the length of the sleeve of the balun. The sleeve conductor of the balun may also form the common grounding conductor, with each helical element terminating at a distal edge of the sleeve. In an alternative embodiment, the distal edge of the sleeve is open circuit, and the common grounding conductor is the outer screen of the feeder structure.

The invention also includes, from another aspect, a method of manufacturing an antenna as described above, comprising forming the antenna core from the dielectric material, and metallising the external surfaces of the core according to a predetermined pattern. Such metallisation may include coating external surfaces of the core with a metallic material and then removing portions of the coating to leave the predetermined pattern, or alternatively a mask may be formed containing a negative of the predetermined pattern, and the metallic material is then deposited on the external surfaces of the core while using the mask to mask portions of the core so that the metallic material is applied according to the pattern.

A particularly advantageous method of producing an antenna having a balun sleeve and a plurality of antenna elements forming part of a radiating element structure, comprises the steps of providing a batch of the dielectric material, making from the batch at least one test antenna core, and then forming a balun structure, preferably without any radiating element structure, by metallising on the core a balun sleeve having a predetermined nominal dimension which affects the frequency of resonance of the balun structure. The resonant frequency of this test resonator is then measured and the measured frequency is used to derive an adjusted value of the balun sleeve dimension for obtaining a required balun structure resonant frequency. The same measured frequency can be used to derive at least one dimension for the antenna elements of the radiating element structure to give a required antenna elements frequency characteristic. Antennas manufactured from the same batch of material are then produced with a balun sleeve and antenna elements having the derived dimensions.

BRIEF DESCRIPTION OF THE DRAWINGS

In the drawings:

FIG. 3 is a fragmentary perspective view of part of the antenna;

FIG. 4 is a cut-away perspective view of a test resonator;

FIG. 5 is a diagram of a test rig including the resonator of FIG. 4; and FIG. 6 is a diagram of an alternative test rig.

DETAILED DESCRIPTION OF THE PREFERRED EMBODIMENTS

Figure 1:
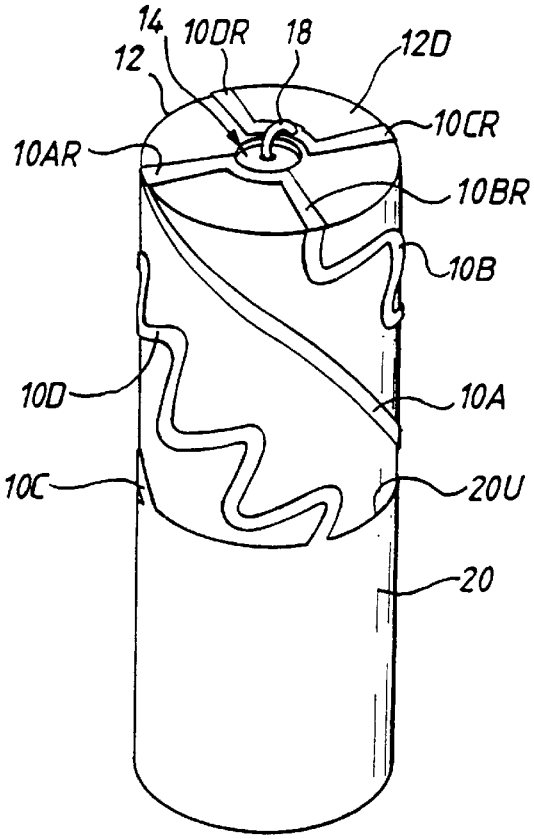
FIG. 1 is a perspective view of an antenna in accordance with the invention.

Referring to the drawings, a quadrifilar antenna in accordance with the invention has an antenna element structure with four longitudinally extending antenna elements 10A, 10B, 10C, and 10D formed as metallic conductor tracks on the cylindrical outer surface of a ceramic core 12. The core has an axial passage 14 with an inner metallic lining 16, and the passage houses an axial feeder conductor 18. The inner conductor 18 and the lining 16 in this case form a feeder structure for connecting a feed line to the antenna elements 10A–10D. The antenna element structure also includes corresponding radial antenna elements 10AR, 10BR, 10CR, 10DR formed as metallic tracks on a distal end face 12D of the core 12 connecting ends of the respective longitudinally extending elements 10A–10D to the feeder structure. The other ends of the antenna elements 10A–10D are connected to a common grounding conductor 20 in the form of a plated sleeve surrounding a proximal end portion of the core 12. This sleeve 20 is in turn connected to the lining 16 of the axial passage 14 by plating 22 on the proximal end face 12P of the core 12.

As will be seen from FIG. 1, the four longitudinally extending elements 10A–10D are of different lengths, two of the elements 10B, 10D being longer than the other two 10A, 10C by virtue of following a meandering course. In this embodiment, intended for circularly polarised signals, the shorter longitudinally extending elements 10A, 10C are simple helices, each executing a half turn around the axis of the core 12. On the other hand, the longer elements 10B, 10D each follow a respective meandering course which is sinusoidal in shape, deviating on either side of a helical centre line. Each pair of longitudinally extending and corresponding radial elements (for example 10A, 10AR) constitutes a conductor having a predetermined electrical length. In the present embodiment, it is arranged that the total length of each of the element pairs 10A, 10AR; 10C, 10CR having the shorter length corresponds to a transmission delay of approximately 135° C. at the operating wavelength, whereas each of the element pairs 10B, 10BR; 10D, 10DR produce a longer delay, corresponding to substantially 225°C. Thus, the average transmission delay is 180°, equivalent to an electrical length of $\lambda/2$ at the operating wavelength. The differing lengths produce the required phase shift conditions for a quadrifilar helix antenna for circularly polarised signals specified in Kilgus, "Resonant Quadrifilar Helix Design", The Microwave Journal, December 1970, pages 49–54. Two of the element pairs 10C, 10CR; 10D, 10DR (i.e. one long element pair and one short element pair) are connected at the inner ends of the radial elements 10CR, 10DR to the inner conductor 18 of the feeder structure at the distal end of the core 12, while the radial elements of the other two element pairs 10A, 10AR; 10B, 10BR are connected to the feeder screen formed by metallic lining 16. At the distal end of the feeder structure, the signals present on the inner conductor 18 and the feeder screen 16 are approximately balanced so that the antenna elements are connected to an approximately balanced source or load, as will be explained below.

The effect of the meandering of the elements 10B, 10D is that propagation of a circularly polarised signal along the elements is slowed in the helical direction compared with the speed of propagation in the plain helices 10A, 10C. The sealing factor by which the path length is extended by the meandering can be estimated using the following equation:

$$\textit{Path length factor} = \left[\int_0^{2n\pi} \frac{\phi}{\cos\{\tan^{-1}[an\cos(n\phi)]\}}\, d\phi\right] \Big/ 2\pi$$

where:

- $\phi$ is the distance along the centre line of the meandered track, expressed in radians;
- a is the amplitude of the meandered path, also in radians; and
- n is the number of cycles of meandering.

With the left handed sense of the helical paths of the longitudinally extending elements 10A–10D, the antenna has its highest gain for right hand circularly polarised signals.

If the antenna is to be used instead for left hand circularly polarised signals, the direction of the helices is reversed and the pattern of connection of the radial elements is rotated through 90°C. In the case of an antenna suitable for receiving both left hand and right hand circularly polarised signals, albeit with less gain, the longitudinally extending elements can be arranged to follow paths which are generally parallel to the axis. Such an antenna is also suitable for use with vertically and horizontally polarised signals.

In the preferred embodiment, the conductive sleeve 20 covers a proximal portion of the antenna core 12, thereby surrounding the feeder structure 16, 18, with the material of the core 12 filling the whole of the space between the sleeve 20 and the metallic lining 16 of the axial passage 14. The sleeve 20 forms a cylinder having an axial length $l_s$ as show in FIG. 2 and is connected to the lining 16 by the plating 22 of the proximal end face 12P of the core 12. The combination of the sleeve 20 and plating 22 forms a balun so that signals in the transmission line formed by the feeder structure 16, 18 are converted between an unbalanced state at the proximal end of the antenna to a balanced state at the axial position corresponding to the upper edge 20U of the sleeve 20. To achieve this effect, the length $l_s$ is such that, in the presence of an underlying core material of relatively high relative dielectric constant, the balun has an electrical length of $\lambda/4$ at the operating frequency of the antenna. Since the remainder of the feeder structure 16, 18, i.e. distally of the upper edge 20U of the sleeve 20, is embedded in the core material 12 and, to a lesser extent, since the annular space surrounding the inner conductor 18 is filled with an insulating dielectric material 17 having a relative dielectric constant greater than that of air, the feeder structure distally of the sleeve 20 has a short electrical length. Consequently, signals at the distal end of the feeder structure 16, 18 are at least approximately balanced.

The antenna has a main resonant frequency of 500 MHz or greater, the resonant frequency being determined by the effective electrical lengths of the antenna elements and, to a lesser degree, by their width. The lengths of the elements, for a given frequency of resonance, is also dependent on the relative dielectric constant of the core material, the dimensions of the antenna being substantially reduced with respect to an air-cored similarly constructed antenna.

The preferred material for the core 12 is zirconium-titanate material. This material has the above-mentioned relative dielectric constant of 36 and is noted also for its dimensional and electrical stability with varying temperature. Dielectric loss is negligible. The core may be produced by extrusion or pressing.

The antenna elements 10A–10D, 10AR–10DR are metallic conductor tracks bonded to the outer cylindrical and end surfaces of the core 12, each track being of a width at least four times its thickness over its operative length. The tracks may be formed by initially plating the surfaces of the core 12 with a metallic layer and then selectively etching away the layer to expose the core according to a pattern applied in a photographic layer similar to that used for etching printed circuit boards. Alternatively, the metallic material may be applied by selective deposition or by printing techniques. In all cases, the formation of the tracks as an integral layer on the outside of a dimensionally stable core leads to an antenna having dimensionally stable antenna elements.

With a core material having a substantially higher relative dielectric constant than that of air, e.g. $\in_{r=36}$, an antenna as described above for L-band GPS reception at 1575 MHz typically has a core diameter of about 5 mm and the longitudinally extending antenna elements 10A–10D have a longitudinal extent (i.e. parallel to the central axis) of about 8 mm. The width of the elements 10A–10D is about 0.3 mm and the meandered elements 10B, 10D deviate from a helical mean path by about 0.9 mm on each side of the mean path, measured to the centre of the meandered track. Typically, there are five complete sinusoidal cycles of meander in each element 10B, 10D to produce the required 90° phase difference between the longer and shorter of the elements 10A–10D. At 1575 MHz, the length of the balun sleeve 22 is typically in the region of 8 mm or less. Expressed in terms of the operating wavelength λ in air, these dimensions are, for the longitudinal (axial) extent of the elements 10A–10D: 0.042λ., for the core diameter: 0.026λ., for the balun sleeve: 0.042λ or less, for the track width: 0.002λ., and for the deviation of the meandered tracks: 0.005λ. Precise dimensions of the antenna elements 10A–10D can be determined in the design stage on a trial and error basis by undertaking eigenvalue delay measurements until the required phase difference is obtained.

In general, however, the longitudinal extent of elements 10A–10D is between 0.03λ and 0.06λ., the core diameter between 0.02λ to 0.03λ., the balun sleeve between 0.03λ to 0.06λ., the track width between 0.0015λ to 0.0025λ., and the deviation of the meandered tracks between 0.0035λ to 0.0065λ.

As a result of the very small size of the antenna, manufacturing tolerances may be such that the precision with which the resonant frequency of the antenna can be maintained is insufficient for certain applications. In these circumstances, adjustment of the resonant frequency can be brought about by removing plated metallic material from the core, e.g. by laser erosion of part of the balun sleeve 20 where it meets one or more of the antenna elements 10A–10D as shown in FIG. 3. Here, the sleeve 20 has been eroded to produce notches 28 on either side of the junction with the antenna element 10A to lengthen the element thereby reducing its resonant frequency.

A significant source of production variations in resonant frequency is the variability of the relative dielectric constant of the core material from batch to batch. In a preferred method of manufacturing the antenna described above, a small sample of test resonators is produced from each new batch of ceramic material, these sample resonators preferably each having an antenna core dimensioned to correspond to the nominal dimension of the core of the antenna and plated only with the balun, as shown in FIG. 4. Referring to FIG. 4, the test core 12T, in addition to having a plated balun sleeve 20T, also has a plated proximal face 12PT. The inner passageway 14T of the core 12T may be plated between the proximal face 12PT and the level of the upper edge 2OUT of the balun sleeve 12T or, as is shown in FIG. 4, it may be plated over its whole length with a metallic lining 16T. The external surfaces of the core 12T distally of the balun sleeve 20T are preferably left unplated.

The core 12T is pressed or extruded from the ceramic material batch to nominal dimensions, and the balun sleeve is plated with a nominal axial length. This structure forms quarter-wave resonator, resonating at a wavelength λ corresponding approximately to four times the electrical length of the sleeve 20T when fed at the proximal end of the passage 14T where it meets the proximal end face 12PT of the core.

Next, the resonant frequency of the test resonator is measured. This can be performed as shown diagrammatically in FIG. 5 by taking a network analyzer 30 and coupling its swept frequency source 30S to the resonator, here shown by the reference numeral 32T, using, for example, a coaxial cable 34 with the outer screen removed over the length of a short end portion 34E. End portion 34E is inserted in the proximal end of the passage 14T (see FIG. 4) with the outer screen of cable 34 connected to the metallised layer 16T adjacent the proximal face 12PT of the core 12T, and with the inner conductor of the cable 34 lying approximately centrally in the passage 14T to provide capacitive coupling of the swept frequency source inside the passage 14T. Another cable 36, with its end portion 36E having the outer screen similarly cut back, is connected to the signal return 30R of the network analyzer 30 and is inserted in the distal end of the passage 14T of the core 12T. The network analyzer 30 is set to measure signal transmission between source 30S and return 30R and a characteristic discontinuity is observed at the quarter-wave resonant frequency. Alternatively, the network analyzer can be set to measure the reflected signal at the swept frequency source 30S using the single cable arrangement shown in FIG. 6. Again, a resonant frequency can be observed.

The actual frequency of resonance of the test resonator depends on the relative dielectric constant of the ceramic material forming the core 12T. An experimentally derived or calculated relationship between a dimension of the balun sleeve 20T, for example, its axial length, on the one hand and resonant frequency on the other hand, can be used to determine how that dimension should be altered for any given batch of ceramic material in order to achieve the required resonant frequency. Thus, the measured frequency can be used to calculate the required balun sleeve dimension for all antennas to be made from that batch.

Figure 2:
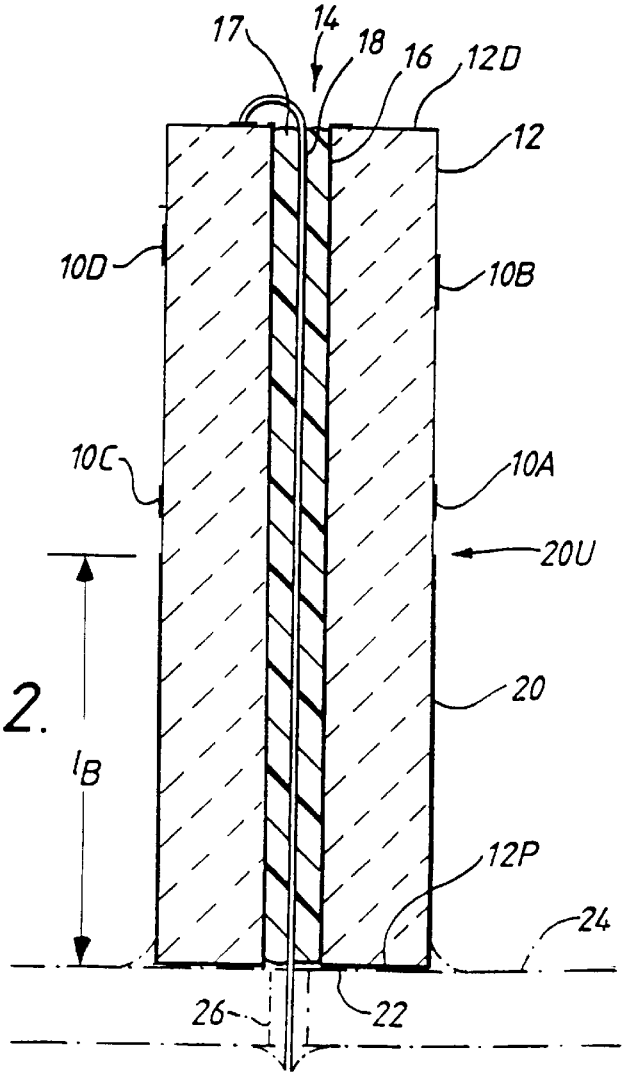
FIG. 2 is a diagrammatic axial cross-section of the antenna.

This same measured frequency, obtained from the simple test resonator, can be used to adjust the dimensions of the radiating element structure of the antenna, in particular the axial length of the antenna elements 10A–10D plated on the cylindrical outer surface of the core distally of the sleeve 20 (using reference numerals from FIGS. 1 and 2). Such compensation for variations in relative dielectric constant from batch to batch may be achieved by adjusting the overall length of the core as a function of the resonant frequency obtained from the test resonator.

Using the above-described method, it may be possible, depending on the accuracy with which the frequency characteristics of the antenna are to be set, to dispense with the laser trimming process described above with reference to FIG. 3. Although it is possible to use a complete antenna as a test sample, the advantage of using a resonator as described above with reference to FIG. 4, i.e. without a radiating element structure, is that a simple resonance can be identified and measured in the absence of interfering resonances associated with the radiating structure.

The above-described balun arrangement of the antenna, being plated on the same core as the antenna elements, is formed simultaneously with the antenna elements, and being integral with the remainder of the antenna, shares its robustness and electrical stability. Since it forms a plated external shell for the proximal portion of the core 12, it can be used for direct mounting of the antenna on a printed circuit board, as shown in FIG. 2. For example, if the antenna is to be end-mounted, the proximal end face 12P can be directly soldered to a ground plane on the upper face of a printed circuit board 24 (shown in chain lines in FIG. 2). With the inner feed conductor 18 passing directly through a plated hole 26 in the board for soldering to a conductor track on the lower surface. Since the conductor sleeve 20 is formed on a solid core of material having a high relative dielectric constant, the dimensions of the sleeve to achieve the required 90° phase shift are much smaller than those of an equivalent balun section in air. The sleeve 20 also has the effect of extending the ground up to the level of the upper edge 20U where it is used for grounding the antenna elements 10A–10D, without intervening connecting elements.

It is possible within the scope of the invention to use alternative balun and feeder structures. For example, the feeder structure may have associated with it a balun mounted at least partly externally of the antenna core 12. Thus, a balun can be effected by dividing a coaxial feeder cable into two coaxial transmission lines acting in parallel, one being longer than the other by an electrical length of $\lambda/2$, the other ends of these parallel-connected coaxial transmission lines having their inner conductors connected to a pair of inner conductors passing through the passageway 14 of the core 12 to be connected to respective pairs of the radial antenna elements 10AR, 10DR; 10BR, 10CR.

As another alternative, the antenna elements 10A–10D can be grounded directly to an annular conductor at the proximal edge of the cylindrical surface of the core 12, a balun being formed by an extension of the feeder structure having a coaxial cable formed into, for example, a spiral on the proximal end face 12P of the core, so that the cable spirals outwardly from the inner passage 14 of the core to meet the annular conductor at the outer edge of the end face 12P where the screen of the cable is connected to the annular conductor. The length of the cable between the inner passageway 14 of the core 12 and the connection to the annular ring is arranged to be $\lambda/4$ (electrical length) at the operating frequency.

All of these arrangements configure the antenna for circularly polarised signals. Such in antenna is also sensitive to both vertically and horizontally polarised signals, but unless the antenna is specifically intended for circularly polarised signals, the balun arrangement can be omitted. The antenna may be connected directly to a simple coaxial feeder, the inner conductor of the feeder being connected to all four radial antenna elements 10AR–10DR at the upper face of the core 12, and the coaxial feeder screen being coupled to all four longitudinally extending elements 10A–10D via radial conductors on the proximal face 12P of the core 12. Indeed, in less critical applications, the elements 10A–10D need not be helical in their configuration, but it is merely sufficient that the antenna element structure as a whole, comprising the elements and their connections to the feeder structure, should be a three-dimensional structure so as to be responsive to both vertically and horizontally polarised signals. It is possible, for example, to have an antenna element structure comprising two or more antenna elements each with an upper radial connecting portion as in the illustrated embodiment, but also with a similar lower radial connecting portion and with a straight portion connecting the radial portions, parallel to the central axis. Other configurations are possible. This simplified structure is particularly applicable for cellular mobile telephony. A notable advantage of the antenna for handheld mobile telephones is that the dielectric core largely avoids detuning when the antenna is brought close to the head of the user. This is in addition to the advantages of small size and robustness.

As for the feeder structure within the core 12, in some circumstances it may be convenient to use a pre-formed coaxial cable inserted inside the passage 14, with the cable emerging at the end of the core opposite to the radial elements 10AR to 10DR to make a connection with receiver circuitry, for example, in a manner other than by the direct connection to a printed circuit board described above with reference to FIG. 2. In this case the outer screen of the cable should be connected to the passage lining 16 at two, preferably more, spaced apart locations.

In most applications the antenna is enclosed in a protective envelope which is typically a thin plastics cover surrounding the antenna either with or without an intervening space.

What is claimed is:

1. An antenna for operation at a frequency greater than 200 MHz comprising:

a three-dimensional antenna element structure defining an interior volume, and a feeder structure which is connected to the antenna element structure, characterized by an electrically insulative core, made of a solid material having a relative dielectric constant greater than five, in that the antenna element structure is disposed on or adjacent the outer surface of the core, in that the feeder structure passes through the core, and in that the solid material of the core occupies the major part of the said interior volume, the antenna being further characterized by a balun formed on the core.

2. An antenna according to claim 1, wherein the balun is formed by a conductive sleeve extending over the surface of part of the core from a connection with the feeder structure at an end thereof opposite to its connection with the antenna element structure.

3. An antenna according to claim 2, wherein the feeder structure is formed as the combination of (a) an inner conductor and an insulative sleeve housed in a passage through the core, and (b) a coaxial screen conductor formed as a lining on the wall of the passage, the screen conductor being coupled to the conductive sleeve at said opposite end.

4. An antenna according to claim 2, wherein the feeder structure comprises a coaxial cable housed in a passage through the core, the cable having a screen conductor coupled to the conductive sleeve at said opposite end.

5. An antenna according to claim 1, wherein the antenna includes a common interconnecting conductor for a plurality of antenna elements of the antenna element structure, the interconnecting conductor being formed as a sleeve around a portion of the core.

6. An antenna according to claim 1, wherein the antenna element structure comprises a plurality of antenna elements defining an envelope centered on a central longitudinal axis of the antenna, and wherein the feeder structure is coincident with said axis.

7. An antenna according to claim 6, wherein the core is a cylinder and the antenna elements define a cylindrical envelope which is coaxial with the core.

8. An antenna according to claim 7, wherein the core is cylindrical and solid and has an axial passage housing the feeder structure.

9. An antenna according to claim 6, wherein the core is cylindrical and solid and has an axial passage housing the feeder structure.

10. An antenna according to claim 9, wherein the volume of the solid material of the core is at least 50 percent of the internal volume of the envelope defined by the antenna elements, with the said elements lying on an outer cylindrical surface of the core.

11. An antenna according to claim 6, wherein the antenna elements comprise metallic conductor tracks bonded to the core outer surface.

12. An antenna according to claim 1, wherein the material of the core is a ceramic.

13. An antenna according to claim 12, wherein the relative dielectric constant of the material is greater than 10.

14. An antenna according to claim 1, wherein a cylindrical core of solid material with an axial extent at least as great as its outer diameter, and with the diametrical extent of the solid material being at least 50 percent of the outer diameter.

15. An antenna according to claim 14, wherein the core is in the form of a tube having an axial passage of a diameter less than a half of its overall diameter, the inner passage having a conductive lining.

16. An antenna according to claim 1, wherein the antenna element structure comprises a plurality of antenna elements extending from a connection with the feeder structure at a first end of the core to a common interconnecting conductor, which conductor is connected to the feeder structure at a second end of the core, the feeder structure defining a central axis.

17. An antenna according to claim 16, wherein the antenna element structure comprises a plurality of generally helical antenna elements formed as metallic tracks on the outer surface of the core which are generally coextensive in the axial direction.

18. An antenna according to claim 17, wherein each helical element is connected to the feeder structure at one of its ends and to at least one of the other helical elements at its other end.

19. An antenna according to claim 18, wherein the connections to the feeder structure are made with generally radial conductive elements, and each helical element is connected to a ground or virtual ground conductor which is common to all of the helical elements.

20. An antenna for operation at a frequency in excess of 200 MHz, comprising:

a solid electrically insulative antenna core which has a central longitudinal axis and is made of a material having a relative dielectric constant greater than 5, a feeder structure extending through the core on the central axis, and, disposed on the outer surface of the cote, a plurality of antenna elements which are connected to the feeder structure at one end of the core and extend in the direction of the opposite end of the core to a common interconnecting conductor, and a balun formed on the core.

21. An antenna according to claim 20, wherein the core has a constant external cross-section in the axial direction, with the antenna elements being conductors plated on the surface of the core.

22. An antenna according to claim 21, wherein the antenna elements comprise a plurality of conductor elements extending longitudinally over the portion of the core having a constant external cross-section, and in that the longitudinally extending elements are connected to the feeder structure at the said one end of the core by a plurality of radial conductor elements.

23. An antenna according to claim 22, wherein the balun is formed by a conductive sleeve extending over part of the length of the core from a connection with the feeder structure at said opposite end of the core.

24. An antenna according to claim 23, wherein the balun sleeve forms the common conductor for the longitudinally extending conductor elements, and wherein the feeder structure comprises a coaxial line having an inner conductor and an outer screen conductor, the conductive sleeve of the balun being connected at said opposite end of the core to the feeder structure outer screen conductor.

25. An antenna according to claim 20, wherein the core is solid and has a cylindrical outer surface, in that the antenna elements comprise at least four longitudinally extending elements on the cylindrical outer surface of the core, wherein corresponding radial elements on a distal end face of the core connect the longitudinally extending elements to the conductors of the feeder structure.

26. An antenna according to claim 25, wherein the longitudinally extending elements are of different lengths.

27. An antenna according to claim 25, wherein radial elements connecting the longitudinally extending elements to the feeder structure at any one end face of the core are coplanar.

28. An antenna according to claim 20, wherein the interconnecting conductor is a sleeve around a portion of the core.

29. An antenna according to claim 28, wherein the antenna elements and the sleeve are plated on the outer surface of the core.

30. An antenna according to claim 29, wherein the antenna elements comprise axially extending conductors which are connected to the feeder structure by a plurality of connecting conductors which extend radially from the axis and are plated on an end face of the core.

31. An antenna according to claim 20, wherein antenna element structure in the form of a plurality of helical elements formed as helices having a common central axis, a substantially axially located feeder structure having an inner feed conductor and an outer screen conductor with each helical element having one end coupled to a distal end of the feeder structure and its other end connected to a common ground or virtual ground conductor, wherein the balun comprises a conductive sleeve located coaxially around the feeder structure, the sleeve being spaced from the outer screen of the feeder structure by a coaxial layer of insulative material having a relative dielectric constant greater than 5, with the proximal end of the sleeve connected to the feeder structure outer screen.

32. An antenna according to claim 31, wherein the sleeve conductor of the balun forms the common grounding conductor, with each helical element terminating at a distal edge of the sleeve.

33. An antenna according to claim 31, wherein the distal edge of the sleeve is open circuit, and the common conductor is the outer screen of the feeder structure.

34. Radio communication apparatus comprising an antenna for operation at a frequency greater than 200 MHz, the antenna comprising a three-dimensional antenna element structure defining an interior volume, and a feeder structure which is connected to the antenna element structure, characterized by an electrically insulative core, made of a solid material having a relative dielectric constant greater than five, in that the antenna element structure is disposed on or adjacent the outer surface of the core, in that the feeder structure passes through the core, and in that the solid material of the core occupies the major part of the said interior volume, the antenna being further characterized by a balun formed on the core.

35. An antenna for operation at frequencies in excess of 200 MHZ comprising:

a solid, elongate, electrically insulative core having a central longitudinal axis and made of a material having a relative dielectric constant greater than 5;

a feeder structure extending through the core on the central axis;

disposed on the outer surface of the core, a plurality of antenna elements which are connected to the feeder structure at one end of the core and extend in the direction of the opposite end of the core; and a balun formed on the core.

36. An antenna according to claim 35, wherein said balun comprises a conductor extending over part of the length of the core from a connection with the feeder structure at said opposite end of the core.

37. An antenna according to claim 36, wherein the feeder structure comprises a coaxial line having an inner conductor and an outer screen conductor, the balun conductor being connected at said opposite end of the core to said outer screen conductor.

38. An antenna for operation at a frequency in excess of 200 MHz, comprising an electrically insulative antenna core of a solid material having a relative dielectric constant greater than 5, the core having distal and proximal faces, a three-dimensional antenna element structure disposed on or adjacent an outer surface of the core and defining an interior volume, a feeder structure which is connected to the antenna element structure at or adjacent the distal end of the core and passes through the core to the proximal end of the core, the material of the core occupying the major part of said interior volume, and a balun formed on the core.

39. An antenna for operation at frequencies in excess of 200 MHz, comprising an electrically insulative core of a solid material having a relative dielectric constant greater than 5, a three-dimensional antenna element structure disposed on or adjacent an outer surface of the core and defining an interior volume, coaxial feeder structure which passes through the core, and a balun on said core outer surface, the feeder structure and the balun providing an electrically balanced feed connection with the antenna element structure, the material of the core occupying the major part of the interior volume.

40. An antenna for operation at a frequency in excess of 200 MHz comprising:

an elongate feeder structure;

a dielectric core in the form of an electrically insulative dielectric body which surrounds the feeder structure and is made of a solid material having a relative dielectric constant greater than 10, the core having an outer surface directed away from the feeder structure, said outer surface enclosing an interior volume at least 50 percent of which is occupied by said material;

a plurality of longitudinally co-extensive elongate antenna elements connected to a feeder connection on the feeder structure;

a balun conductor on said dielectric body outer surface extending towards the antenna elements from a connection of said balun conductor to the feeder structure at a location remote from said feeder connection.

41. An antenna according to claim 40, wherein the antenna elements comprise at least one pair of diametrically opposed helical conductors sharing a common axis and a common radius.

42. An antenna according to claim 41, wherein the antenna elements are dielectrically loaded.

43. An antenna according to claim 40, wherein the balun conductor extends in a direction substantially parallel to the feeder structure and has an electrical length in said direction of $\lambda/4$ at the operating frequency of the antenna.

44. An antenna according to claim 40, wherein the feeder structure comprises the coaxial combination of an inner feed conductor and an outer screen, and the balun conductor is connected to said outer screen at said location remote from said feeder connection.

45. An antenna according to claim 44, wherein the core has end surfaces extending substantially perpendicularly to the feeder, and wherein the balun conductor has a first part on one of said end surfaces and a second part on said core outer surface.

46. An antenna according to claim 45, wherein the antenna elements are connected to the feeder connection by respective radially extending conductors on the other of said end surfaces.

* * * * *